United States Patent [19]

Thoma

[11] Patent Number: 4,569,319

[45] Date of Patent: Feb. 11, 1986

[54] AIR-COMPRESSING INJECTION INTERNAL COMBUSTION ENGINE, ESPECIALLY FOR PASSENGER MOTOR VEHICLES

[75] Inventor: Frank Thoma, Stuttgart, Fed. Rep. of Germany

[73] Assignee: Daimler-Benz Aktiengesellschaft, Fed. Rep. of Germany

[21] Appl. No.: 146,193

[22] Filed: May 5, 1980

Related U.S. Application Data

[63] Continuation-in-part of Ser. No. 880,106, Feb. 22, 1978, abandoned.

[30] Foreign Application Priority Data

Feb. 26, 1977 [DE] Fed. Rep. of Germany ..... 2708437

[51] Int. Cl.[4] ..... F02M 39/00

[52] U.S. Cl. ..... 123/357; 123/339

[58] Field of Search ..... 123/368, 339, 373, 364, 123/365, 366, 367, 357–359

[56] References Cited

U.S. PATENT DOCUMENTS

| | | | |
|---|---|---|---|
| 2,924,208 | 2/1960 | Grozinger | 123/357 |
| 3,640,258 | 2/1972 | Isobe | 123/365 |
| 3,964,457 | 6/1976 | Coscia | 123/339 |
| 4,099,506 | 7/1978 | Kolb | 123/179 L |
| 4,143,634 | 3/1979 | Ritter | 123/366 |
| 4,267,808 | 5/1981 | Djordjevic | 123/367 |
| 4,286,558 | 9/1981 | Diordjevic | 123/373 |

*Primary Examiner*—Carl Stuart Miller
*Attorney, Agent, or Firm*—Craig and Burns

[57] ABSTRACT

An air-compressing fuel injected internal combustion engine which includes a fuel injection pump for supplying predetermined quantities of fuel to the engine in response to a positioning of a control rod. A load lever is operatively connected with an accelerator pedal and a governor is operatively connected to the fuel injection pump for controlling a positioning of the control rod in dependence upon a rotational speed of the engine. An idling spring is operatively connected with the governor for regulating the position thereof and the idling spring is pretensioned as a function of the rotational speed by an independent idling control arrangement so as to control an injection quantity of the fuel by the fuel injection pump in accordance with an actual idling rotational speed of the engine.

15 Claims, 6 Drawing Figures

AIR-COMPRESSING INJECTION INTERNAL COMBUSTION ENGINE, ESPECIALLY FOR PASSENGER MOTOR VEHICLES

This application is a continuation-in-part application of Ser. No. 880,106, filed Feb. 22, 1978, now abandoned.

The present invention relates to an air-compressing internal combustion engine, especially for passenger motor vehicles, which includes a governor operatively associated with an injection pump, a drive pedal connected with the governor, and an idling adjustment means for controlling the idling rotational speed of the engine.

By reason of the uneven running of the engine at excessively low idle rotational speeds, especially air-compressing internal combustion engines for passenger motor vehicles, there is a requirement to control such rotational speeds.

While a manual control of the idling rotational speed of an air-compressing internal combustion engine has been proposed, a disadvantage of such proposal resides in the fact that the manual control requires a continuous re-adjustment and is, therefore, frequently undertake only inadequately.

In, for example, U.S. Pat. No. 4,099,506, a temperature-controlled adjusting member for the adjustment of an idling rotational speed is proposed wherein a load lever of an accelerator rack of an injection pump is displaced by a temperature controlled adjusting member so as to move the control rod to a "more" fuel position when the engine is cold. With a cold engine, especially in a vehicle provided with an automatic transmission, power steering, air conditioning and the like, a high frictional load must be overcome during a starting phase of the engine for the first 20–30 seconds because of the increased viscosity of the oil. After this period of time, the engine then operates at an undesireable high rotational speed. Since neither the temperature of the coolant of the engine nor the temperature of the motor oil can react sufficiently rapidly to counteract the high rotational speed, a temperature-dependent control element will not achieve a desired controlling of the rotational speed. Even a temporarily electrically heated control element, because of its inertia, will not achieve the desired rotational speed control because, after the heater is shut off, the heated element, made of an expandable material, will first have to give off the heat to the environment before a slow change in its length takes place. Moreover, there is no comparison of actual and set rotational speed values.

As can readily be appreciated, a disadvantage of constructions such as proposed by the aforementioned U.S. patent resides in the fact that the interference magnitude such as engine oil viscosity, wear condition of the internal combustion engine, and additional load occasioned by, for example, the engagement of the automatic transmission, actuation of the servo steering system, etc., cannot be taken into consideration by a temperature-controlled adjustment.

In U.S. Pat. No. 3,964,457, an idling rotational speed control arrangement is provided which controls the fuel-air mixture as a function of the rotational speed of the engine, through a carburetor, while an actual rotational speed of the engine is compared with a predetermined set rotational speed, and a throttle valve of the carburetor is more or less opened in dependence upon the resultant value of the rotational speed of the engine.

The aim underlying the present invention essentially resides in providing a construction which enables a bringing of the idling rotational speed of the internal combustion engine to a desired value by a control detecting all interference magnitudes and also to maintain the rotational speed at the desired value.

In accordance with advantageous features of the present invention, a separate idling control installation is provided, which is adapted to change an idling abutment or suitable member in the injection pump governor in accordance with the idling rotational speed in a direction toward a maintenance of the desired idling rotational speed of the engine.

In accordance with the present invention, an actual value of the idling rotational speed is measured by a control installation and is compared with a desired value stored in an idling control installation. In case of a possible deviation, the fuel quantity to be injected is changed for such a length of time until two values coincide or until a minimum measure is approached. By reason of a large degree of irregularity in operation, the injection pump is not capable of providing the required control. Thus, for example, at a high load of the internal combustion engine during idling, the adjusted idling rotational speed remains too small. The deviation between actual and desired rotational speed is too large. However, the large degree of irregularity or imbalance is necessary for the injection pump because, at smaller values, the engine governor system becomes unstable and the idling rotational speed fluctuates sinusoidally. The idling speed control installation of the present invention is preferably superimposed on a normal unjection pump governor having a large degree of irregularity or inbalance. Thus, the present invention proposes providing, in addition to a governor of the injection pump, a further, specifically preprogrammed idling control installation which is operative, independently of the number of revolutions of the internal combustion engine so as to regulate and maintain idling revolutions at a definite and desired value by means of an adjustment or positioning motor.

In order that the control corresponds to the practical requirements, a control behavior should be selected in which the control, on the one hand, operates so rapidly that during a starting of additional loads such as, for example, an engagement of the automatic transmission, the internal combustion engine does not stall, yet on the other hand, not so rapidly that an instability occurs especially in conjunction with the injection pump governor.

The control installation of the present invention may additionally be so constructed that the stored desired rotational speed varies as a function of time so that a more rapid heat up of the internal combustion engine takes place as a result of a higher idling rotational speed during the phase following the starting operation of the engine.

The idling control installation according to the present invention may be constructed so as to be switched on and off by the steering or ignition lock controlling the operation of the engine. As a result thereof, the disengaging or turning-off devices otherwise required at the engine may be dispensed with because the engine is turned off by way of the idling control installation.

In accordance with advantageous features of the present invention, an idling abutment may be provided so as to influence the position of a load lever such as, for example, a drive pedal of a vehicle with the idling abutment being connected with an adjusting motor. By advancing or retracting the adjusting motor, which may be driven pneumatically or hydraulically, the idling abutment and therewith the load lever or drive pedal is adjusted and the idling rotational speed is controlled and adjusted to the desired value.

During a driving operation, the engine rotational speed is generally greater than the idling rotational speed. The control installation of the present invention attempts, in this case, to throttle the rotational speed to a desired value and therewith the injection quantity of fuel injected by a fuel injection pump by retracting the adjusting motor. In order to prevent a stalling of the engine during a sudden retraction of the drive pedal or load level because in the meantime the idling abutment has been retracted too far, the idling abutment may be adapted to be blocked by an idling control installation. As a result thereof, the retraction of the adjusting motor is limited to a value which results by taking into consideration all interference magnitudes as a lower boundary value of the control range.

However, it is also possible in accordance with the present invention, to block the adjusting motor by the control installation in a position which has pre-existed when lifting off the drive pedal or load lever from the idling abutment. This blocking may be introduced, for example, by opening a contact provided between the drive pedal and the idling abutment.

Advantageously, according to the present invention, the adjusting motor is adapted to engage on an idling spring of an injection pump regulator or present an idler stop adapted to act on a special member in the first regulator provided on the adjusting motor that can be influenced by the idling control installation.

Accordingly, it is an object of the present invention to provide an air-compressing internal combustion engine, especially for passenger motor vehicles which avoids, by simple means, shortcomings and disadvantages encountered in the prior art.

Another object of the present invention resides in providing an air compressing internal combustion engine in which an automatic control of the idling rotational speed is achieved, taking into consideration all interference magnitudes that are deemed of any significance.

A further object of the present invention resides in providing a control installation for controlling an idling rotational speed of an air compressing internal combustion engine which is able to bring the idling rotational speed to a desired value and to keep the same at such desired value.

A still further object of the present invention resides in providing a control installation for an idling speed of an air compressing fuel-injected internal combustion engine, which operates sufficiently rapidly without jeopardizing the proper operation of the engine under other operating conditions.

Still a further object of the present invention resides in providing a control installation for an idling speed of an air compressing fuel injected internal combustion engine which is simple in construction and obviates the need for certain other previously needed control devices.

These and other objects, features, and advantages of the present invention will become more apparent from the following description when taken in connection with the accompanying drawing which show, for the purposes of illustration only, several embodiments in accordance with the present invention, and wherein.

Figure 1:
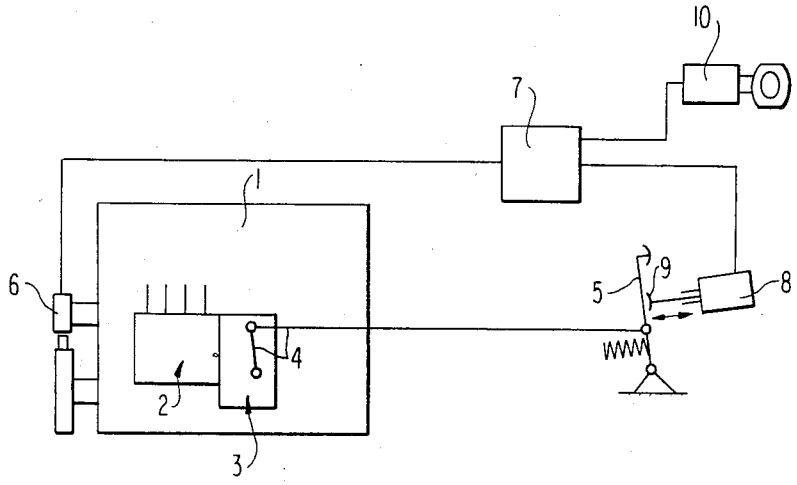
FIG. 1 is a schematic view of one embodiment of a control installation in accordance with the present invention.

Referring now to the drawings wherein like reference numerals are used throughout the various views to designate like parts and, more particularly, to FIG. 1, according to this figure, an air-compressing internal combustion engine 1 is provided with a fuel injection pump generally designated by the reference numeral 2 and fuel injection pump governor generally designated by the reference numeral 3 pivotally connected with a drive pedal 5 by way of a linkage 4. A pulse transmitter, of conventional construction, feeds a pulse to an electrically controlled idling control installation 7, of conventional construction, which is adapted to determine from a spacing of the pulses from the pulse transmitter 6 with respect to time, an actual rotational speed of the internal combustion engine 1. The idling rotational speed control installation 7 adjusts by way of a conventional, preferably electrically driven adjusting motor 8, an idling abutment 9 which, for example, may act on a drive pedal 5, whereby the injection quantity of the injection pump 3 is so changed by way of the linkage 4 that the actual rotational speed will adjust itself to a desired value stored in the idling control installation 7.

The turning off of the internal combustion engine 1 takes place by a rotation of a key in the ignition lock 10. An electrical signal is thereby fed to the idling control installation 7 which effects a retraction of the adjusting motor 8 and of the idling abutment 9 connected therewith whereby the injection quantity is decreased to zero.

Adjusting motor 8 may also be driven pneumatically or hydraulically and may also be attached directly to the injection pump 2 and may act directly on the linkage 4 or suitable members in the injection pump governor in a manner described more fully hereinbelow in connection with FIGS. 2–6.

The idling control installation may also be so constructed by conventional means so that the desired rotational speed stored therein changes as a function of time. Thus, for example, a more rapid heat up of the internal combustion engine 1 may take place by a higher idling rotational speed during an operating phase following the starting of the internal combustion engine 1. In a driving operation, in which the rotational speed of the internal combustion engine 1 lies above the idling rotational speed, the idling control installation 7 attempts, by retraction of the adjusting motor 8 and therewith the idling abutment 9, to bring the rotational speed of the internal combustion engine 1 to the stored desired value. In order that the internal combustion engine 1 does not stall during a sudden retraction of the drive pedal 5, the retraction of the adjusting motor 8 is limited to a value which represents the lower boundary value of the control range. The adjusting motor 8 may also be blocked by the idling control installation 7 in a position, for example, by opening of a contact arranged between the drive pedal 5 and the idling abutment 9, into which it had been adjusted when lifting off the drive pedal 5 from the idling abutment 9.

Figure 2:
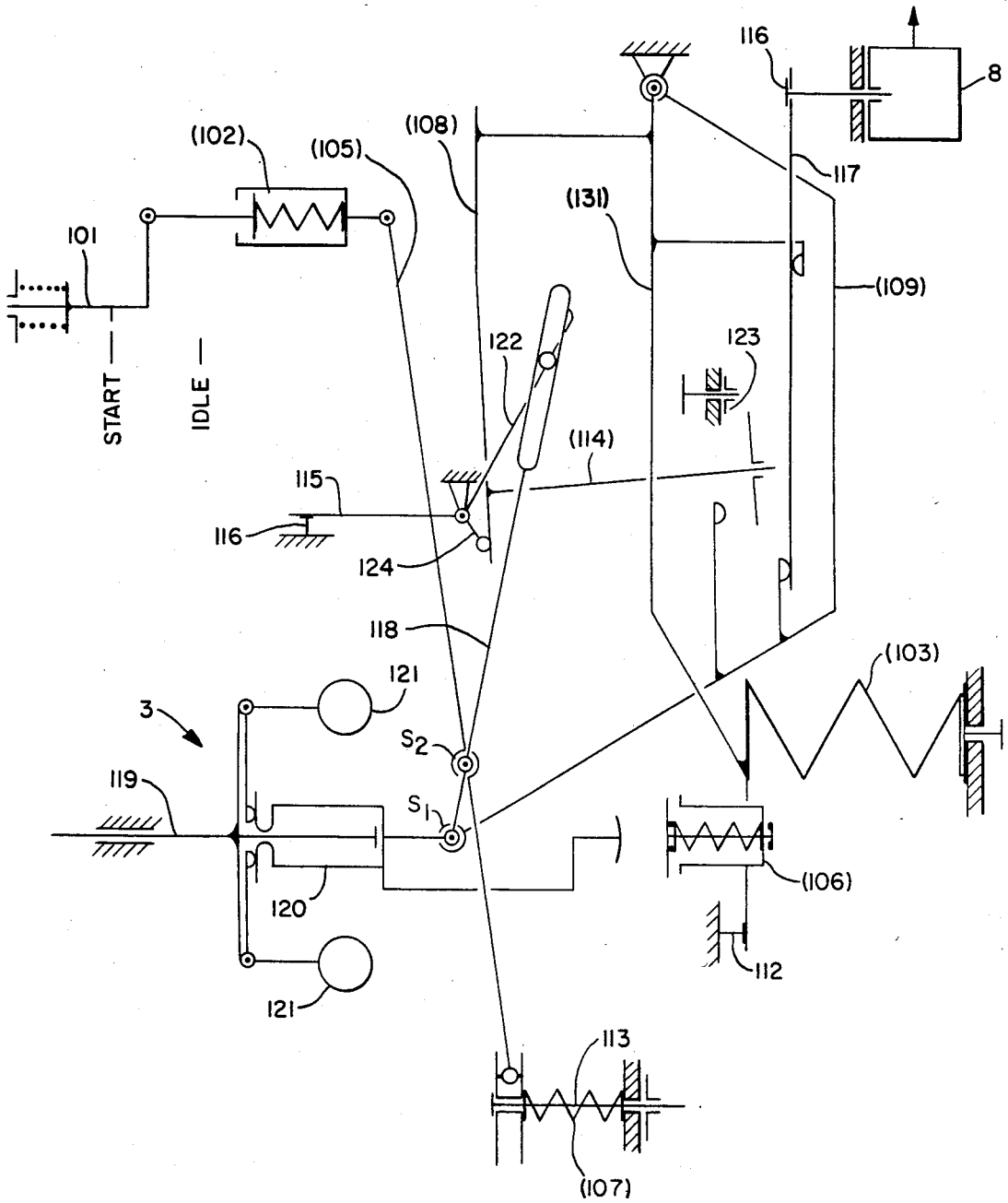
FIG. 2 is a schematic view of another embodiment of a control installation in accordance with the present invention in a starting position.
Figure 3:
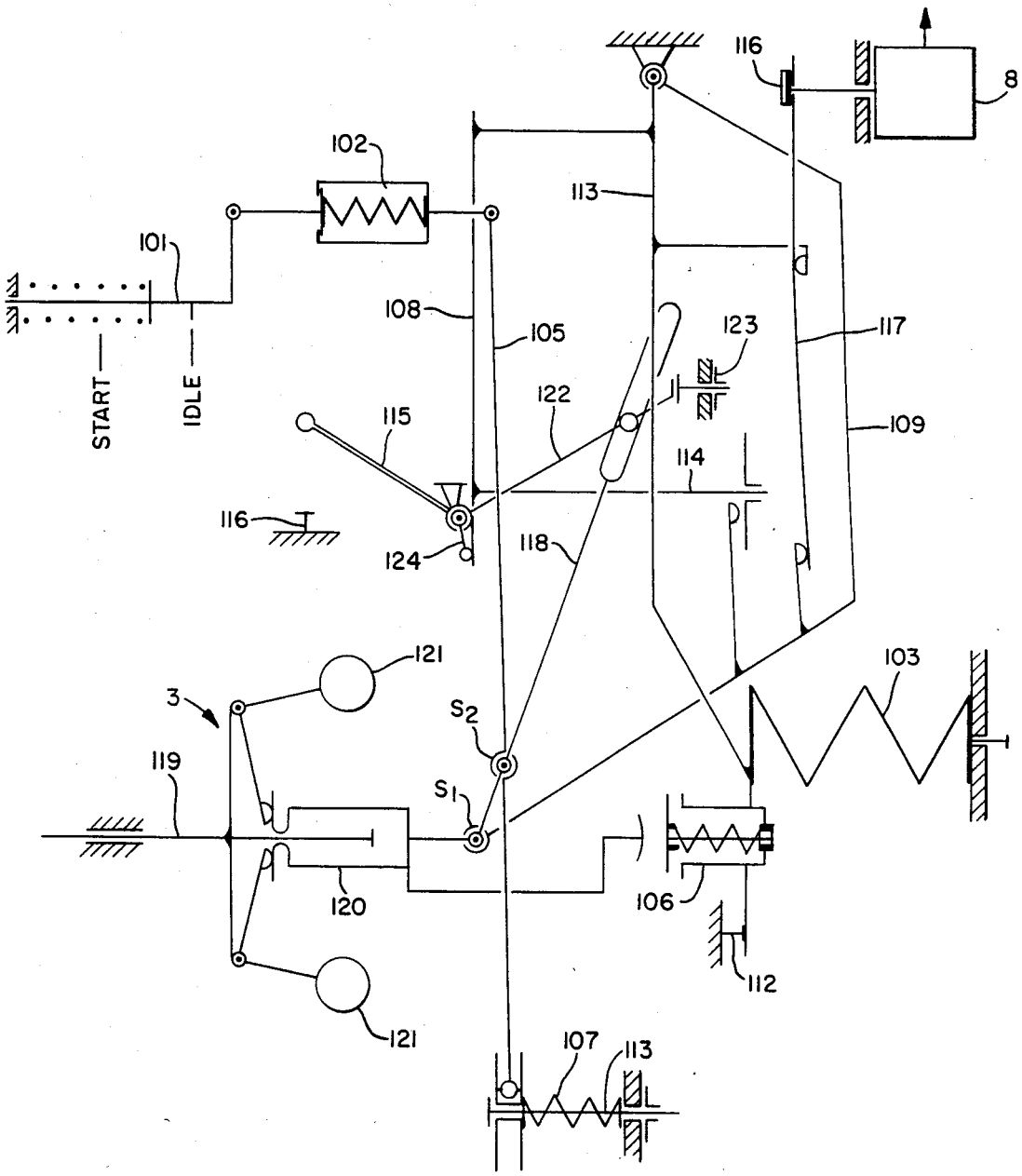
FIG. 3 is a schematic view of the embodiment of FIG. 2 in a control position.
Figure 4:
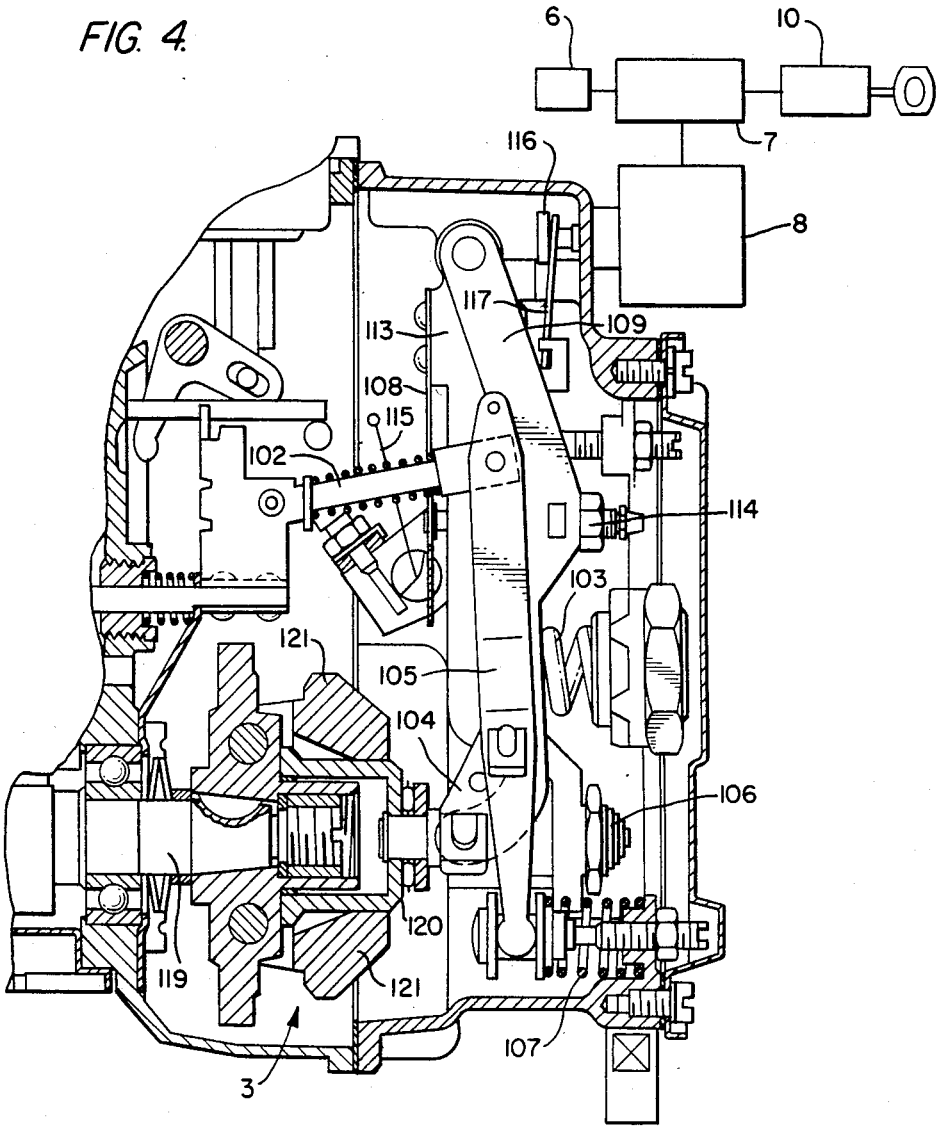
FIG. 4 is a cross sectional view of a fuel injection pump provided with the control installation of FIG. 2.

FIGS. 2–4 provide an example of the control installation of the present invention attached directly to the injection pump and acting directly on suitable members in the injection pump for controlling injected fuel quantities in a diesel engine. According to these figures, the adjusting or positioning motor 8 cooperates with a full load stop or idling abutment 116 and an idle spring 117. The fuel injection pump includes a control rod 101 for controlling the quantity of fuel injected, with the control rod 101 being responsive to movements of a connecting lever 105. An over pressure means 102 is interposed between the connecting lever 105 and the control rod 101 with the opposite end of the connecting lever 105 being connected to a full load adjustment screw 113 through an over pressure limit 107. In certain cases, the control rod 101 of the fuel injection pump rests against a starting abutment and the control rod 101 may advance if the operator of a vehicle steps on the accelerator with the vehicle at rest or shuts off the engine.

A centrifugal governor 3, provided with flyweights 121, is operatively connected to a cam shaft 119, with the governor 3 acting or controlling the injection pump through a sleeve means 120 in a conventional manner. The connecting lever 105 is adapted to transfer the load and rotational speed signal from the governor to the control rod 101. For this purpose, the connecting lever 105 is pivotally connected by pivot means $S_1$,$S_2$ to a rocker arm or lever 118, adapted to transfer the position of a load lever 115, connected to an accelerator pedal, to the fuel pump or control rod 101, and the sleeve means 120.

A positive compensating means 106 is provided for effecting a certain shaping to a full load curve, described more fully hereinbelow in connection with FIG. 6, in correspondence to a demand on the engine and an urging or nudging spring 108 is provided for increasing the idling rotational speed in the lower range, i.e., idle control curve in FIG. 6. An idle lever 109, under the force of the idle spring 117, is adapted to displace the pivot point $S_2$ of the rocker arm or lever 118 and the connecting lever 105. A nudging pin 114 provides an adjustable connection between the spring 108 and the idle lever 109.

The idle spring 117, having a pivot point located on an end-of-travel control lever 131, is pretensioned as a function of the rotational speed of the engine by the supplementary control afforded by the adjusting or positioning motor 8 so that a comparison of the set value and actual value of the rotational speed of the engine can be obtained by the idle control device. An end-of-travel control spring 103 is provided and is adapted to act when the control is dropped from the maximum rotational speed of the engine.

The load lever 115 and rocker arm or lever 118 are operatively connected by an articulated lever 122. A nudging shut off cam 124 is provided for disconnecting the nudging spring 108 to prevent the control rod 101 from moving to a position so as to supply a starting volume of fuel at low rotational speeds of the engine.

Figure 6:
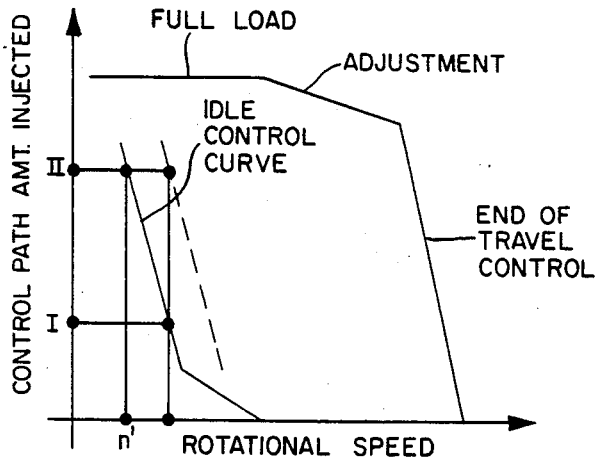
FIG. 6 is a graphical representation of an idle control curve obtained by the control installation of the present invention.
Figure 5:
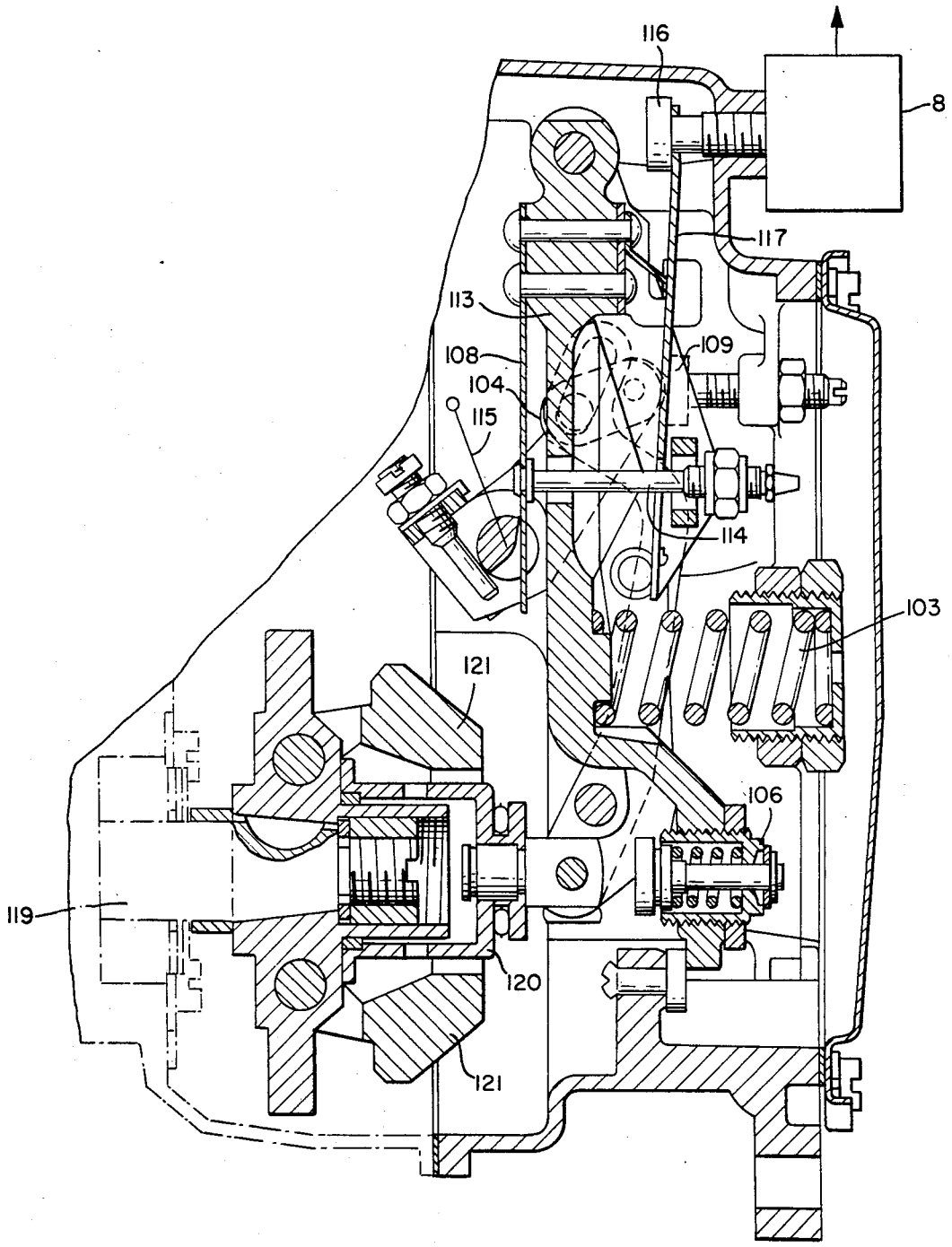
FIG. 5 is a cross sectional view of the fuel injection pump of FIG. 4 on a somewhat enlarged scale with parts thereof removed for clarity.

FIG. 6 provides a diagramatic illustration of the control behavior of the control installation of the present invention with the points designated I and II, respectively, indicating the operating of the engine at a zero load and operating at idling speeds loaded by, for example, an automatic transmission, power steering, air conditioning, etc. As shown in FIG. 6, the main controller or governor of the fuel injection pump is overriden by the operation of the adjusting motor 8 so that the idle curve is shifted in such a fashion that the idling rotational speed $n_1$, which drops to $n'$ under a load, is raised again to a rotational speed of $n_1$.

The operation of the control installation of FIGS. 2–5 is as follows:

With the engine stopped, upon starting the engine, the flyweights 121 are forced by the idle spring 117 to their inner most position (FIG. 2) by the idle lever 109 and sleeve 120. If the load lever 115 is adjusted by an accelerator pedal to two-thirds of the maximum load, the control rod 101 is displaced to the starting position. If the load lever 115 is then advanced further to the full load position, against the full load stop 116, the control rod 101 cannot be advanced further because of its connection with the overpressure means 107.

In order to prevent the control rod 101 from moving to the starting volume at a low rotational speed of the engine and with the load lever 115 in the full load position, the cam 124 on the load lever 115 disconnects the spring 108 whereby the spring force on the sleeve 120 and therefore the restoring forces on the flyweights 121 are reduced. The flyweights 121 then immediately overcome the idle spring 117 through sleeve 120 and idle lever 109 to a greater extent and are displaced outwardly (FIG. 3). The control rod travel to the full load volume position is limited by the sleeve 120, rocker lever 118, connecting lever 105, and the connection to the adjustable overpressure means 107.

During an idle operation, the articulated pivot lever 122 rests against the inner idle abutment or stop 123. There is an equilibrium between the force exerted by the flyweights 121 through the sleeve 120 and the idle lever 109 on the idle spring 117 and the reactive force. As the rotational speed decreases, the flyweights 121 are forced inward by the idle spring 117. The control rod 101 is displaced in the full load direction by the sleeve 120, rocker lever 118, connecting lever 105, and the connection to the overpressure means 107. As the rotational speed increases, the adjustment is reversed. Depending on the load on the engine at idle, for example, with a cold engine and auxiliary unit such as the transmission, power steering unit, etc. being switched on, the idling rotational speed wanders up and down the control curve of FIG. 6 adjusting the required amount of fuel to be injected with the idle rotational speed changing as a function of the steepness of the control curve.

The spring 108 has a retarding effect if the accelerator is suddenly depressed or, in other words, the spring 108 is intended to prevent the control installation from undershooting and thereby causing an excessively rapid drop in the engine rotational speed. The spring 108 exerts its effect from beyond the idle point to the uncontrolled range.

The behavior of the control installation in determining the end of travel is as follows:

At a full load point, before the end-of-travel regulation begins, the force of the sleeve 120 and the control spring force are at equilibrium. If the rotational speed now further increases, also resulting in an increase in the force of the sleeve 120, the end-of-travel control spring 103 is compressed by the displacement of the sleeve 120 and movement of the end-of-travel control lever 131. The control rod 101 is simultaneously withdrawn due to the movement of the sleeve 120, rocker lever or arm 118, and connecting lever 105 and the connection to the overpressure means 107.

The end-of-travel control spring 103 is compressed until equilibrium is established between the spring restoring force and the displacement force caused by the flyweights 121 or, in other words, at the upper idle point, the volume of fuel injected is proportional to the frictional power of the engine.

In a certain range of uncontrolled operation, the flyweights 121 exert excess pressure through the sleeve 120 and idle lever 109 on the idle spring 117 and spring 108. The sleeve 120 rests against the compensating spring chamber of the compensating element 106 which causes a positive adjustment.

If the rotational speed of the engine continues to rise, the increasing adjustment force of the flyweights 121 forces the spring in the compensating chamber of the compensating means 106 by virtue of the displacement of the sleeve 120. The control rod 101 is pushed into the stop position by the rocker lever 118, connecting lever 105, and the connection to the compensating spring.

Shortly before de-regulation begins, compensation has already been completed. The operating range for compensation is determined by the pretensioning force of the compensating spring, the spring constant of such spring, and the structurally predetermined compensating path.

To shut off the engine, when the ignition key is turned from an on position to an off position, a vaccum is created through a valve (not shown) interposed between a vacuum pump (not shown) and a diaphragm chamber so that the control rod 101 is moved into the off position by a shut off lever.

While I have shown and described two embodiments in accordance with the present invention, it is understood that the same is not limited thereto but is susceptible of numerous changes and modifications as known to one having ordinary skill in the art and I therefore do not wish to be limited to the details shown and described herein but intend to cover all such modifications and changes as are encompassed by the scope of the appended claims.

I claim:

1. An air compressing fuel injected internal combustion engine comprising a fuel injection pump means for supplying predetermined quantities of fuel to the engine in response to a positioning of a control rod means, a load lever means operatively connected to an accelerator pedal, and governor means operatively connected to the fuel injection pump means for controlling a position of the control rod means in dependence upon a rotational speed of the internal combustion engine, characterized in that an idling spring means is operatively connected with the governor means for regulating a position thereof, the governor means includes a displaceable sleeve means, means are provided for connecting the sleeve means with the idle spring means, means are provided for connecting the sleeve means with the control rod means, means are provided for connecting the load lever means with the sleeve means, means are provided for pretensioning the idling spring means as a function of the rotational speed of the engine so as to control an injection quantity of fuel by the fuel injection pump means in accordance with an actual idling rotational speed of the internal combustion engine, said pretensioning means includes an independent idling control means for determining an actual rotational speed of the internal combustion engine, said independent idling control means includes an adjusting motor, an idle abutment means displaceable by said adjusting motor for operatively connecting the adjusting motor with the idle spring means, the means for connecting the sleeve means with the idle spring means includes an idle lever pivotally connected at one end thereof to the sleeve means, said means for connecting the sleeve means with the control rod means includes a connecting lever means for transferring a rotational speed signal from the governor means to the control rod means, and in that said means for connecting the load lever means with the sleeve means includes a rocker lever pivotally connected at one end thereof to said sleeve means and pivotally connected at a position spaced from said one end thereof to said connecting lever means, and an articulated lever means for connecting a second end of the rocker lever to the load lever means.

2. An air compressing fuel injected internal combustion engine according to claim 1, characterized in that the adjusting motor is an electrically driven adjusting motor.

3. An air compressing fuel injected internal combustion engine according to claim 1, characterized in that the adjusting motor is a pneumatically driven adjusting motor.

4. An air compressing fuel injected internal combustion engine according to claim 1, characterized in that the adjusting motor is a hydraulically driven adjusting motor.

5. An air compressing fuel injected internal combustion engine according to claim 1, characterized in that a full load adjustment means is operatively connected with the connecting lever means at an end thereof opposite an end connected with the control rod means.

6. An air compressing fuel injected internal combustion engine according to claim 5, characterized in that an overpressure means is interposed between the control rod means and the connecting lever means.

7. An air compressing fuel injected internal combustion engine according to one of claims 1, 5 or 6, characterized in that means are provided for enabling a positive compensation for operation of the engine in a predetermined rotational speed range, said compensation means is cooperable with said sleeve means of said governor means.

8. An air compressing fuel injected internal combustion engine according to claim 7, characterized in that means cooperable with the load lever means are provided for increasing an idle rotational speed of the engine in a lower operating range thereof.

9. An air compressing fuel injected internal combustion engine according to claim 8, characterized in that said means for increasing the rotational speed of the engine in the lower operating range includes a spring element.

10. An air compressing fuel injected internal combustion engine according to claim 9, characterized in that means are provided for adjusting a tensioning of the spring element.

11. An air compressing fuel injected internal combustion engine comprising a fuel injection pump means for supplying predetermined quantities of fuel to the engine in response to a positioning of a control rod means, a load lever means operatively connected to an accelerator pedal, and governor means operatively connected to the fuel injection pump means for controlling a position of the control rod means in dependence upon a rotational speed of the internal combustion engine, characterized in that an idling spring means is operatively connected with the governor means for regulating a position thereof, means are provided for pretensioning the idling spring means as a function of the rotational speed of the engine so as to control an injection quantity of the fuel by the fuel injection pump means in accordance with an actual idling rotational speed of the internal combustion engine, the governor means includes a displaceable sleeve means, means are provided for connecting the sleeve means with the idle spring means, means are provided for connecting the sleeve means with the control rod means, means are provided for connecting fhe load lever means with the sleeve means, the means for connecting the sleeve means with the idle spring means includes an idle lever pivotally connected at one end thereof to the sleeve means, said means for connecting the sleeve means with the control rod means includes a connecting lever means for transferring a rotational speed signal from the governor means to the control rod means, and in that said means for connecting the load lever means with the sleeve means includes a rocker lever pivotally connected at one end thereof to said sleeve means and pivotally connected at a position spaced from said one end thereof to said connecting lever means, and an articulated lever means for connecting a second end of the rocker lever to the load lever means.

12. An air compressing fuel injected internal combustion engine according to claim 11, characterized in that means are provided for enabling a positive compensation for operation of the engine in a predetermined rotational speed range, said compensation means is cooperable with said sleeve means of said governor means.

13. An air compressing fuel injected internal combustion engine according to one of claims 1, or 11, characterized in that means cooperable with the load lever means are provided for increasing an idle rotational speed of the engine in a lower operating range thereof.

14. An air compressing fuel injected internal combustion engine according to claim 13, characterized in that said means for increasing the rotational speed of the engine in the lower operating range includes a spring element.

15. An air compressing fuel injected internal combustion engine according to claim 14, characterized in that means are provided for adjusting a tensioning of the spring element.

* * * * *